United States Patent [19]

Beattie et al.

[11] 4,151,778

[45] May 1, 1979

[54] MULTI-RATIO QUICK ADJUSTING MACHINE HEAD FOR GUITAR TUNING

[76] Inventors: Lawrence E. Beattie, 917 NE. 8th Ct., Pompano Beach, Fla. 33060; Robert R. Worthing, 5000 NW. 76th Pl., Pompano Beach, Fla. 33067

[21] Appl. No.: 893,473

[22] Filed: Apr. 4, 1978

[51] Int. Cl.[2] ..... G10D 3/14

[52] U.S. Cl. ..... 84/306

[58] Field of Search ..... 84/204, 304, 306

[56] References Cited

U.S. PATENT DOCUMENTS

| | | | |
|---|---|---|---|
| 360,186 | 3/1887 | White | 84/306 |
| 361,500 | 4/1887 | Gardner | 84/306 |
| 609,715 | 8/1898 | Wettengel | 84/306 |
| 1,309,658 | 7/1919 | Sage | 84/306 |
| 1,498,487 | 6/1924 | Smith | 84/306 |

*Primary Examiner*—Lawrence R. Franklin

*Attorney, Agent, or Firm*—Malin & Haley

[57] ABSTRACT

A string tensioning device for use on stringed musical instruments such as violins, guitars, and cellos. More particularly, a device capable of adjusting the tension on the strings of musical instruments at two different ratios while the device is in place on the musical instrument. Said device having as one of its components a worm screw, said screw being easily interchangeable with another similar screw with different spacings of the threads on the screw so as to give the user any desired tension adjusting ration.

1 Claim, 3 Drawing Figures

MULTI-RATIO QUICK ADJUSTING MACHINE HEAD FOR GUITAR TUNING

BACKGROUND OF THE INVENTION

This invention relates to a string tensioning device, directly applicable to stringed musical instruments such as violins, guitars, and cellos.

The usual one piece tuning peg suffers from the disadvantage of having so much friction between the peg and the peg box to sustain the string tension that fine tuning is difficult. Early attempts to solve this problem by using lubricants and friction bearings were partially successful. Greater success was achieved later by using gears which allowed turning ratios different than 1:1. However, such geared devices made it impossible to quickly adjust string tension over a wide band since the turning ration required a great number of turns to increase the tension even slightly.

More recently a string tensioning device as described in U.S. Pat. No. 3,726,172 to Sorkin was developed which allowed the user a 1:1 turning ratio for larger tension adjustment while still allowing the user a different turning ratio for finer tension adjustments. However, the device disclosed by Sorkin allows only a 1:1 turning ratio plus one additional turning ratio of say 10:1. The simple 1:1 ratio may be used on all types of instrument to achieve quick drastic tension adjustments. However, the additional turning ratio may be the most desirable ratio on one instrument but not another and the most desirable ratio on a given instrument may vary depending on the type of music being played.

SUMMARY OF THE INVENTION

It is the primary object of this invention to present an improved tuning peg which is interchangeable with the usual tuning peg.

Another object is to present such a tuning peg with a first mode for initial course tuning.

Another object is to present such a tuning peg with a second mode for fine tuning.

Another object is to present such a tuning peg with a worm screw which is easily interchangeable with a different worm screw, said different screw having different threadings on it making it capable of providing a different mode of tuning.

Another object is to provide an economical and easily manufacturable tuning peg.

These together with other objects and advantages will become apparent to those skilled in the art upon reading the details of construction and operation as more fully set forth hereinafter, reference being had to the accompanying drawings forming a part hereof, wherein like numerals refer to like parts throughout.

DETAILED DESCRIPTION OF PREFERRED EMBODIMENTS OF THE INVENTION

Before the present multi-mode string tensioning device is specifically described, it is to be understood that the invention is not limited to the particular arrangement of the parts here shown, as such devices may vary. It is also to be understood that the phraseology or terminology herein used is for purposes of description of particular embodiments and not of limitation, as the scope of the present invention is denoted by the appended claim.

Figure 3:
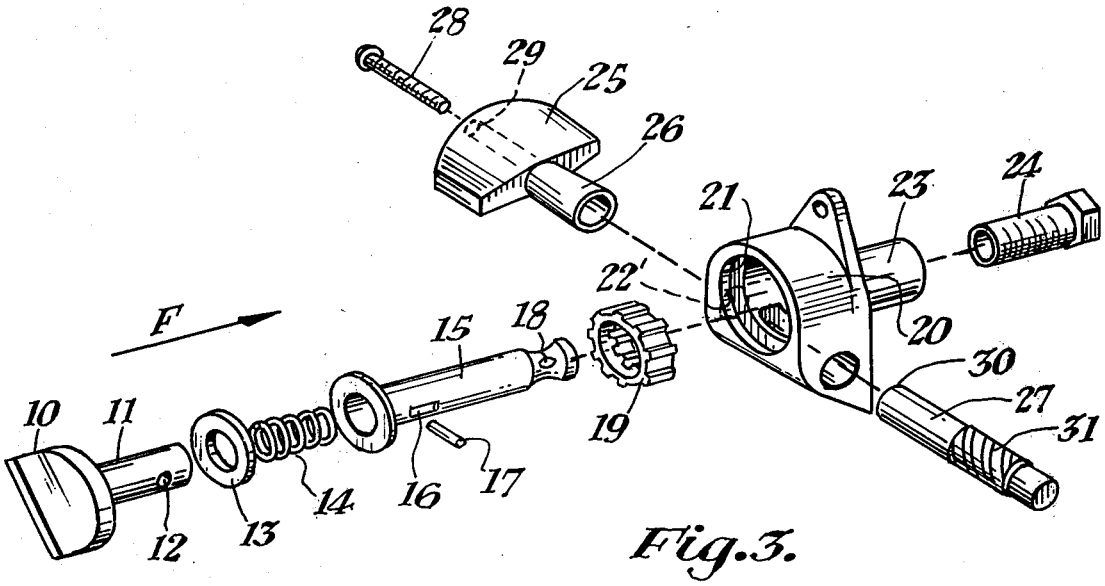
FIG. 3 illustrates the disassembled components of the device.

Referring now to the drawings and more particularly to FIG. 3, in which the disassembled device is shown. The thumb knob 10 is composed of brass or other suitable rigid material. The rod-like protuberance 11 extending from the knob 10 has a hole 12 in it. The thrust washer 13 is composed of brass or other suitable rigid material. The internal diameter of the washer 13 is slightly larger than the external diameter of the rod 11 so that the washer may fit easily over the rod and lay flat against the face of the thumb knob. The external diameter of the helical spring 14 is slightly smaller than the internal diameter of the head shaft 15 so the spring fits snuggly inside the shaft. The shaft 15 has an elongated hole 16 through which the pin 17 may pass, and a second hole 18 through which the string of the instrument may pass and be fastened. The worm wheel referred to generally by the number 19, is composed of steel or other suitable material. The wheel has a plurality of teeth traversing the entire width of its external circumference and a plurality of teeth traversing two-thirds of the width of the internal circumference of the wheel. The housing 20 is composed of plastic or other suitable rigid, easily moldable material. The housing has two intersecting passages 21 and 22 and a tubular protuberance 23 with a threaded inside diameter into which tubular extension 24 may be screwed. The tuning knob 25 is composed of plastic or other suitable rigid, easily moldable material. The knob stem 26 has a hollow inside, into which the worm screw 27 may be inserted. When the screw 27 is inserted into the knob, the screw 28 is inserted through the opening 29 in the knob and into the opening 30 in the worm screw 27. The internal circumference of the worm screw has threadings to match the threads on the screw 28. The external threads 31 on the worm screw 27 will mesh with the gears on the external circumference on the worm wheel 19.

Figure 1:
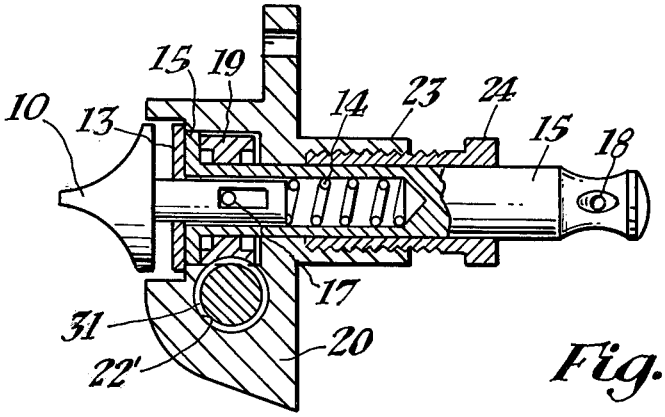
FIG. 1 is a cross-sectional side view of the device completely assembled.
Figure 2:
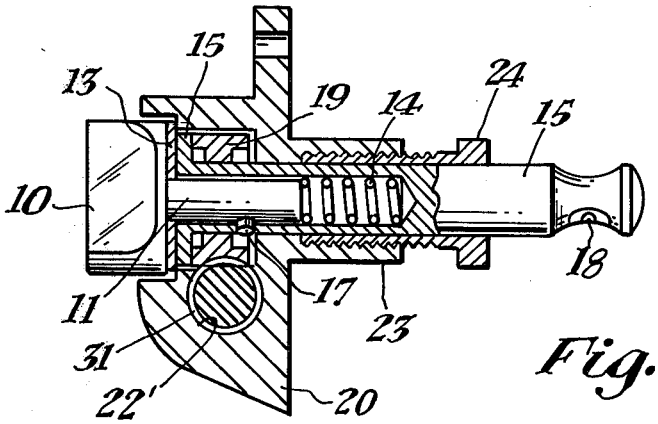
FIG. 2 is a side view of the device completely assembled.

When the device is assembled as in FIG. 1, the spring 14 is inserted inside the shaft 15. The rod 11 is inserted through the washer 13 and into the shaft 15 compressing the spring. The hole 12 is aligned with the hole 16 so that the pin 17 may be inserted through both holes at once thus holding these components together. The wheel 19 is placed within the housing 20 via opening 21 and the shaft 15 is passed through the wheel 19, housing 20, tube 23, and extension 24; said extension being screwed into said tube. The end of shaft 15 extends out of extension 24 so that a string from the instrument may be attached to the shaft via hole 18. The stem 26 is placed into the housing via opening 22'. The worm screw 27 is inserted inside of the housing via opening 22 and further inserted inside the stem 26. The screw 28 is then inserted into opening 29 and then into opening 30 where it is screwed into place. When the worm screw is so inserted within the housing, the threads 21 on said worm screw engage the gears of wheel 19. A cross-sectional view of the assembled device is shown in FIG. 1. FIG. 2 illustrates a top view of the device.

To operate the device and achieve fine tuning, the user turns knob 25 which causes the threads 31 to turn. The threads 31 turn the wheel 19. The teeth on the inside of the wheel engage the pin 17 which turns the shaft 15, thus winding the string attached to the shaft via hole 18. The turning ratio between the shaft 15 and the knob 25 depends on the gears on the exterior of the wheel 19 and the threads 31 on the worm screw. In order to change the ratio, one need only remove screw 28 so that the worm screw 27 may be removed and replaced by another worm screw having different threading 31 on it. The device need not be detached from the musical instrument nor need the strings of the instrument be detached from the device.

In order to get a 1:1 turning ratio, the user need only force the thumb knob 10 in the direction of arrow F of FIG. 3. When the force F is applied, the spring 14 is compressed and the pin 17 slides in the elongated hole 16 and disengages itself from the teeth in the interior circumference of wheel 19. Thus, the shaft 15 can be turned without engaging the wheel or the worm screw, achieving a 1:1 turn ratio between turns of the thumb knob and the shaft with the string attached.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device for adjusting the string tension on stringed musical instruments, said device consisting of:

a housing, said housing being connectible to a stringed musical instrument and having a first cylindrically shaped hole through it and a second cylindrically shaped hole through it, said first and second holes intersecting each other, a turning knob connectible to a stem wherein said stem protrudes partially into the first side of said first hole in said housing, a worm screw wherein said worm screw protrudes into the second side of said first hole, said worm screw being connectible to said stem, a thumb knob, said knob being connectible to a cylindrical protuberance, said protuberance having a hole therein, a head shaft, said shaft being hollowed out so that its interior diameter is slightly larger than the exterior diameter of said cylindrical protuberance, said shaft having an elongated hole near the first end of said shaft where said shaft has been hollowed out, and a second hole in said shaft near the other end, a worm wheel, said wheel having teeth along its exterior circumference and at least some teeth partially along its interior circumference, a pin capable of passing through said hole in said cylindrical protuberance and through said elongated hole in said head shaft, said pin having a length greater than the diameter of the exterior diameter of said head shaft.

* * * * *